US010940657B2

(12) United States Patent
Nii et al.

(10) Patent No.: US 10,940,657 B2
(45) Date of Patent: Mar. 9, 2021

(54) POUCH CONTAINER ALIGNED STRUCTURE, MANUFACTURING DEVICE FOR SAME, AND MANUFACTURING METHOD FOR SAME

(71) Applicants: FUJI SEAL INTERNATIONAL, INC., Osaka (JP); KAO CORPORATION, Tokyo (JP)

(72) Inventors: Satoshi Nii, Osaka (JP); Hideki Ode, Osaka (JP); Akira Uetsuki, Osaka (JP); Shinji Watanabe, Tokyo (JP)

(73) Assignees: KAO CORPORATION, Tokyo (JP); FUJI SEAL INTERNATIONAL, INC., Osaka (JP)

( * ) Notice: Subject to any disclaimer, the term of this patent is extended or adjusted under 35 U.S.C. 154(b) by 287 days.

(21) Appl. No.: 15/754,799

(22) PCT Filed: Jul. 20, 2016

(86) PCT No.: PCT/JP2016/071274
§ 371 (c)(1),
(2) Date: Feb. 23, 2018

(87) PCT Pub. No.: WO2017/033628
PCT Pub. Date: Mar. 2, 2017

(65) Prior Publication Data

US 2018/0244010 A1 Aug. 30, 2018

(30) Foreign Application Priority Data

Aug. 24, 2015 (JP) ..... JP2015-165273

(51) Int. Cl.
*B31B 70/00* (2017.01)
*B31B 70/84* (2017.01)
(Continued)

(52) U.S. Cl.
CPC ..... *B31B 70/844* (2017.08); *B31B 70/261* (2017.08); *B31B 70/60* (2017.08);
(Continued)

(58) Field of Classification Search
CPC ..... B31B 70/844; B31B 70/60; B31B 70/261; B65B 43/52; B65D 67/02; B65D 75/008; B65D 75/5872; B65D 75/5877
(Continued)

(56) References Cited

U.S. PATENT DOCUMENTS 3,327,925 A * 6/1967 Coker ..... B65D 31/142 383/203
4,685,148 A * 8/1987 Titchenal ..... B65D 31/14 383/100
(Continued)

FOREIGN PATENT DOCUMENTS

JP 2016-03056 A 1/2016
WO 2008/096392 A1 8/2008
WO 2015/128427 A1 9/2015

OTHER PUBLICATIONS

Oct. 11, 2016 International Search Report issued in International Patent Application No. PCT/JP2016/071274.

*Primary Examiner* — Peter N Helvey
(74) *Attorney, Agent, or Firm* — Oliff PLC

(57) ABSTRACT

Provided is a pouch container aligned structure, wherein: each pouch container has a folded body part that is the top end of one of a pair of body sheets folded into a substantial V shape, with one end of a top sheet also forming the folded body part by being joined to the top end of the body sheet and the other end of the top sheet forming the distal end portion of the container by being joined to the top end of the other of the pair of body sheets; and the pouch containers are aligned in a state in which the distal end portion of one
(Continued)

pouch container is inserted into the folded body part of another pouch container.

4 Claims, 10 Drawing Sheets

(51) Int. Cl.

| | |
|---|---|
| ***B65B 43/52*** | (2006.01) |
| ***B65D 75/58*** | (2006.01) |
| ***B65D 67/02*** | (2006.01) |
| ***B31B 70/60*** | (2017.01) |
| ***B31B 70/26*** | (2017.01) |
| ***B65D 75/00*** | (2006.01) |

(52) U.S. Cl.
CPC ..... *B65B 43/52* (2013.01); *B65D 67/02* (2013.01); *B65D 75/008* (2013.01); *B65D 75/5872* (2013.01); *B65D 75/5877* (2013.01)

(58) Field of Classification Search
USPC ..... 383/37
See application file for complete search history.

(56) References Cited

U.S. PATENT DOCUMENTS

| | | | | |
|---|---|---|---|---|
| 7,810,667 | B2 * | 10/2010 | Douglas | B65B 43/123 220/23.4 |
| 8,790,229 | B2 * | 7/2014 | Font Lletche | B65D 75/566 493/87 |
| 9,636,883 | B2 * | 5/2017 | Nagano | B31B 70/844 |
| 9,932,161 | B2 * | 4/2018 | Ohmae | B31B 70/844 |
| 2005/0261659 | A1 * | 11/2005 | Mizuo | B65D 75/42 604/410 |
| 2010/0022374 | A1 | 1/2010 | Nagano et al. | |

* cited by examiner

POUCH CONTAINER ALIGNED STRUCTURE, MANUFACTURING DEVICE FOR SAME, AND MANUFACTURING METHOD FOR SAME

TECHNICAL FIELD

The present invention relates to a pouch container aligned structure composed of a plurality of pouch containers aligned in one direction, and to a device and a method for manufacturing the pouch container aligned structure.

BACKGROUND

In the prior art, for example, a fluid-filled pouch container including a spout through which a fluid is filled and extracted has been known from below-listed Patent Document 1. Such pouch containers may be transported from a location where they are manufactured to another location where they are filled with fluid.

CITATION LIST

Patent Literature

Patent Document 1: WO 2008/096392

SUMMARY

Technical Problem

The pouch containers transported to a location where a filler machine is installed may be randomly oriented and positioned in a separated state. In this case, it becomes necessary to manually load, one by one, the pouch containers into the filler machine, which presents a problem of requiring considerable time and effort.

Further, in the separated state of the randomly oriented pouch containers, it is not possible to systematically store the pouch containers in a packaging material, such as, for example, a cardboard box, which impairs compact storage of the containers, resulting in reduced efficiency of both storage and transportation of the containers.

An object of the present invention is to provide a pouch container aligned structure with which a plurality of pouch containers can be automatically loaded into a filler machine with a higher degree of efficiency, and packaged at a higher degree of volume efficiency, and to provide a device and a method for manufacturing the pouch container aligned structure.

Solution to Problem

A pouch container aligned structure according to the present invention is composed of a plurality of pouch containers aligned in one direction, each of the pouch containers including a pair of body sheets joined to each other on both side edges in a width direction of the body sheet, a bottom sheet joined to lower end regions of the pair of body sheets, a top sheet joined to upper end regions of the pair of body sheets, and a spout mounted on the top sheet. In the pouch container aligned structure, each of the pouch containers has a folded body part formed by folding, substantially in a V shape, an upper end region of one body sheet in the pair of body sheets, and an edge region on one side of the top sheet is joined to the upper end region of the one body sheet to thereby form the folded body part together with the upper end region, while an edge region on the other side of the top sheet is joined to the upper end region of the other body sheet in the pair of body sheet to thereby form a container tip end part. Further, in the pouch container aligned structure, the pouch containers are aligned in a state where the folded body part of one of the pouch containers receives an insertion of the tip end part of another one of the pouch containers.

In this configuration, a pair of substantially parallel flat regions are formed on an outer circumferential surface of the spout, and are configured to be guided by a pair of guiding members.

A pouch container aligned structure manufacturing device according to another aspect of the present invention is a device for manufacturing a pouch container aligned structure composed of a plurality of pouch containers aligned in one direction, each of the pouch containers including a pair of body sheets joined to each other on both side edges in a width direction of the body sheet, a bottom sheet joined to lower end regions of the pair of body sheets, a top sheet joined to upper end regions of the pair of body sheets, and a spout mounted on the top sheet. The manufacturing device includes a placement unit on which the pouch container is successively placed in a state where the upper end region of one body sheet in the pair of body sheets is folded substantially in a V shape to form a folded body part in conjunction with an edge region on one side of the top sheet, while an edge region on the other side of the top sheet is joined to the upper end region of the other body sheet in the pair of body sheets to form a container tip end part, a delivery unit which delivers the pouch container placed on the placement unit while pressing down the top sheet, and a guide unit which receives the pouch container delivered by the delivery unit while guiding the spout of the pouch container to align the plurality of pouch containers in one direction. Further, in the manufacturing device, the plurality of pouch containers aligned in the guide unit are maintained in a state where the folded body part of one of the plurality of pouch containers receives an insertion of the container tip end part of another one of the plurality of pouch containers.

In the above configuration, it is preferable that the guide unit is composed of a pair of guiding members extending substantially in parallel to each other, and a pair of substantially parallel flat regions are formed on an outer circumferential surface of the spout, and are configured to be guided by the pair of guiding members.

A pouch container aligned structure manufacturing method according to a further aspect of the present invention is a method for manufacturing a pouch container aligned structure composed of a plurality of pouch containers aligned in one direction, each of the pouch containers including a pair of body sheets joined to each other on both side edges in a width direction of the body sheet, a bottom sheet joined to lower end regions of the pair of body sheets, a top sheet joined to upper end regions of the pair of body sheets, and a spout mounted on the top sheet. The manufacturing method includes a placement step of successively placing the pouch container in a state where the upper end region of one body sheet in the pair of body sheets is folded substantially in a V shape to form a folded body part in conjunction with an edge region on one side of the top sheet, and an edge region on the other side of the top sheet is joined to the upper end region of the other body sheet in the pair of body sheets to form a container tip end part, a delivery step of successively delivering the pouch container placed in the placement step while pressing down the top sheet, and an alignment step of receiving the spout of the pouch container delivered by the delivery step while guiding the spout of the pouch container to align the plurality of pouch containers in one direction. Further, in the manufacturing method, the plurality of pouch containers aligned in the alignment step are maintained in a state where the folded body part of one of the pouch containers receives an insertion of the container tip end part of another one of the pouch containers.

In the above-described configuration, a pair of substantially parallel flat regions formed on an outer circumferential surface of the spout are preferably guided in the alignment step by a pair of guiding members extending substantially in parallel to each other, to thereby establish a state where the pouch containers are aligned in one line.

Advantageous Effects of Invention

According to the pouch container aligned structure of the present invention, because the container tip end part of the another one of the plurality of pouch containers is inserted into the V-shaped folded body part of the one of the pouch containers, the plurality of pouch containers are prevented from being easily separated from each other, and are accordingly maintained in a cluster, which can facilitate handling of the pouch containers. As a result, the plurality of pouch containers can be automatically loaded into the filler machine with a higher degree of efficiency. Further, the plurality of pouch containers gathered in a cluster can be stored in an orderly manner in a packaging material, such as a cardboard box, with a higher degree of volume efficiency.

Moreover, according to the manufacturing device and the manufacturing method for the pouch container aligned structure of the present invention, it becomes possible to manufacture the pouch container aligned structure with which there can be realized both efficient automatic loading into the filler machine and storage in the packaging material with a high degree of volume efficiency.

DESCRIPTION OF EMBODIMENTS

Hereinafter, embodiments of the present invention will be described in detail with reference to the attached drawings. In the description, specific shapes, materials, numerical values, directions, and other features are provided by way of illustration to facilitate understanding of this invention, and may be appropriately changed depending on uses, purposes, specifications, and other factors. Further, when multiple embodiments and modification examples are described below, it is originally intended that characteristic features in the embodiments or modification examples may be used in appropriately combinations.

In the specification of this application (as well as the scope of the claims), the direction in which a bottom sheet and a top sheet are opposed to each other is defined as a "vertical direction," the direction in which a pair of body sheets are stacked is defined as a "front and back direction" of a container, and the direction perpendicular to both the vertical direction and the front and back direction is defined as a "width direction."

Figure 1:
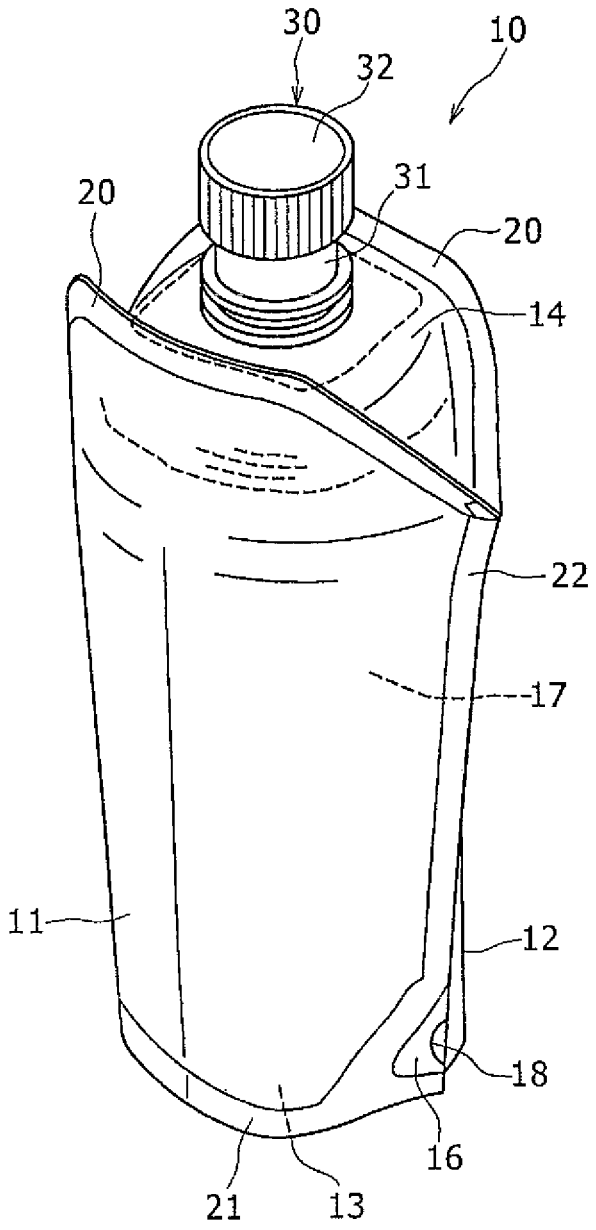
FIG. 1 is a perspective view showing a pouch container (with a capped spout) in which the contents have been filled.
Figure 2B:
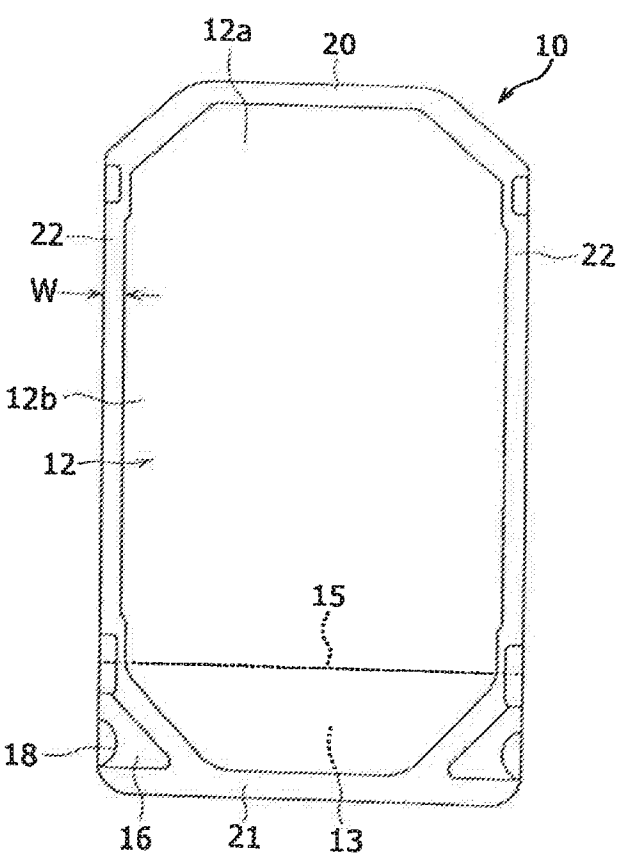
FIG. 2B shows a rearview of the pouch container shown in FIG. 1 before the contents are filled.
Figure 2A:
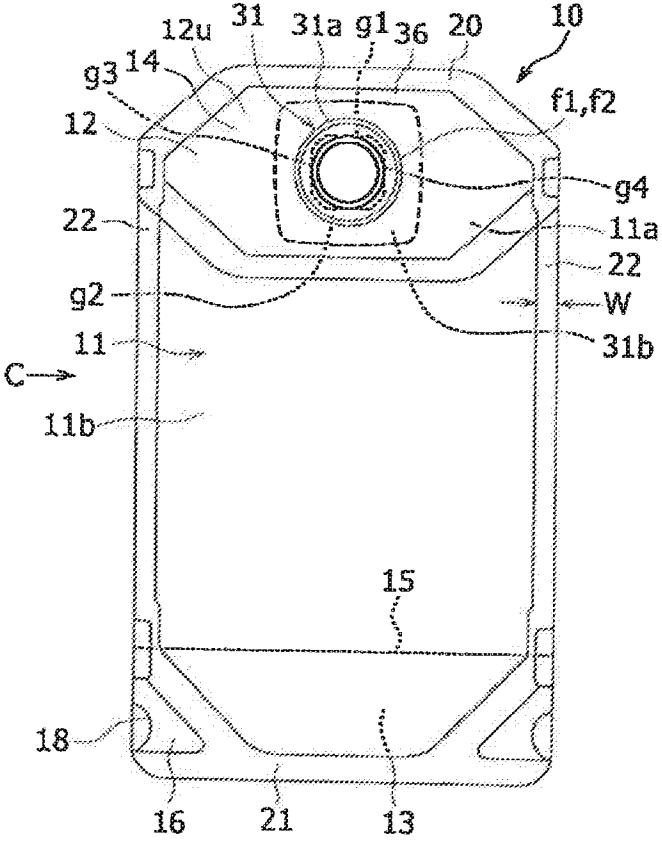
FIG. 2A shows a front view of the pouch container shown in FIG. 1 before the contents are filled.
Figure 3:
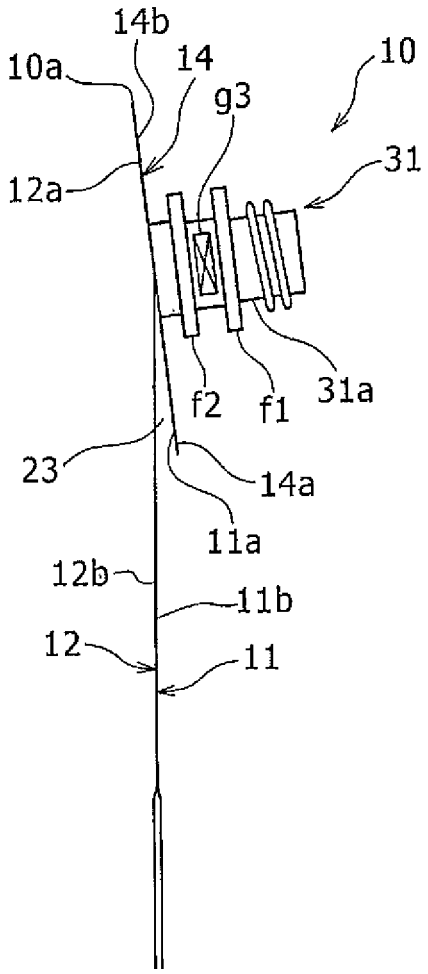
FIG. 3 is a side view of the pouch container of FIG. 2A viewed along an arrow C.

FIG. 1 is a perspective view showing an embodiment of a pouch container 10 after the contents are filled therein. FIG. 2A and FIG. 2B respectively show a front view and a rear view of the pouch container 10 which is in a folded and collapsed state before the contents are filled. Further, FIG. 3 is a side view of the pouch container of FIG. 2A viewed along an arrow C.

As shown in FIGS. 1, 2A and 2B, the pouch container 10 includes a front sheet 11, which is one body sheet in a pair of body sheets, a rear sheet 12, which is the other body sheet in the pair of body sheets, a bottom sheet 13, and a top sheet 14. The pouch container 10 is a freestanding pouch which can freely stand when the bottom sheet 13 is unfolded by filling the contents. The front sheet 11 and the rear sheet 12 are sheet materials, which respectively form a front surface part and a rear surface part of the container, while the bottom sheet 13 is a sheet material constituting a bottom gadget part which is folded and inserted between the front sheet 11 and the rear sheet 12. The bottom sheet 13 is ridge folded at a folding line 15 defined along the width direction so as to project toward an interior of the container. The top sheet 14 is a sheet material constituting a top surface part of the container.

The pouch container 10 is a structure in which seal parts for joining end edges of the sheet materials are formed in a state where the bottom sheet 13 is inserted from a lower end side between the front sheet 11 and the rear sheet 12, which are overlaid in matched position, to seal a filling part 17 of an internal container space to be filled with the contents.

More specifically, the pouch container 10 includes, as the seal parts, a top seal part 20, a bottom seal part 21, and side seal parts 22. The top seal part 20 is a seal part formed in the shape of a substantially octagonal frame on the end edges of the top sheet 14 by joining the outer peripheral edge of the top sheet 14 to each of upper end regions 11*a* and 12*b* of the front sheet 11 and the rear sheet 12. Meanwhile, the bottom seal part 21 is a seal part formed on the end edges of the bottom sheet 13 by joining the bottom sheet 13 to each of lower end regions of the front sheet 11 and the rear sheet 12. Further, on the bottom sheet 13, a rectangular unsealed region 16 is formed on each end in the width direction, and a semi-circular notch 18 is defined at an end edge in the width direction corresponding to the unsealed region 16. The front sheet 11 is directly joined to the rear sheet 12 over the notches 18 of the bottom sheet 13.

The side seal parts 22 are formed respectively on both width ends by directly joining the front sheet 11 and the rear sheet 12 at their end edges in the width direction. The side seal parts 22 are end edge sealing parts similarly with the other seal parts for sealing the filling part 17. The side seal parts 22 are formed so as to extend along the vertical direction. Further, the side seal parts 22 are defined to have a constant width W in the regions other than the upper end region and the lower end region. In this way, the seal parts 20, 21, and 22 are arranged to seal the filling part 17 of the internal container space. The contents to be filled in the filling part 17 may include various care products for daily life, such as shampoo, rinse, conditioner, washing agent, and beverages such as sports drinks, but are not limited thereto. The contents are not limited to liquid, and may be a viscous material or a powdery material.

Both of the front sheet 11 and the rear sheet 12 have substantially rectangular shapes slightly elongated in the vertical direction. The bottom sheet 13 also has a substantially rectangular shape, and is provided in a range of, for example, approximately one-fifth of the entire vertical length, such as the length from the lower ends of the front sheet 11 and the bottom sheet 12 to the front sheet 14. The top sheet 14 has a substantially octagonal shape, and is provided to the upper ends of the front sheet 11 and the rear sheet 12. It should be noted that the top sheet 14 is not limited to the substantially octagonal shape, and may have another polygonal shape, such as a rectangular shape or a hexagonal shape, or may have a circular, elliptical, or rhombic shape.

The sheet material for forming each of the sheets 11 to 14 is a sheet-like member constituting a wall surface part of the pouch container 10, and is usually formed of a resin film. It is necessary for the resin film forming the sheet material to have essential properties for a packaging material, including an impact resistant property, an abrasion resistant property, a heat resistant property, etc. Further, because the seal part is typically formed through heat sealing, the sheet material also needs to have a heat sealing property. As the sheet material, a multi-layered sheet material composed of a base film layer and a sealant layer that provides the heat healing property may be preferably utilized, and when a high degree of gas barrier performance is needed, a gas barrier layer may be preferably inserted between the base film layer and the sealant layer. The thickness of the sheet material may be, for example, 10 μm~300 μm, and is preferably 20 μm~200 μm.

Here, examples of component materials of the base film layer, the sealant layer, and the gas barrier layer will be described. It should be noted that the layers may be laminated with a conventional lamination method, such as, for example, dry lamination using an adhesive agent, or thermal lamination by means of a thermal adhesive layer inserted between layers to thermally bond the layers.

An example of a film for forming the base film layer may include a single layered or two or more layered stretched or unstretched film composed of a material, such as polyester (polyethylene terephthalate (PET), polyethylene naphthalate (PEN), polybutylene terephthalate (PBT), polycarbonate (PC), etc.); polyolefin (polyethylene (PE), polypropylene (PP), etc.); polyamide (nylon 6, nylon 66, etc.); polyacrylonitrile (PAN); polyimide (PI); polyvinyl chloride (PVC); polyvinylidene chloride (PVDC); polymethyl methacrylate (PMMA); and polyether sulfone (PES). The thickness of the base film layer may be, for example, 10 μm~200 μm, and is preferably 10 μm~100 μm.

An example of a film for forming the sealant layer may include a single layered or two or more layered stretched or unstretched films composed of a material, such as low density polyethylene (LDPE), linear low density polyethylene (LLDPE), ethylene-propylene copolymer (EP), unstretched polypropylene (CPP), biaxially oriented nylon (ON), ethylene-olefin copolymer, ethylene-acrylic acid copolymer (EAA), ethylene-methacrylic acid copolymer (EMAA), or ethylene-vinyl acetate copolymer (EVA). The thickness of the sealant layer may be, for example, 20 μm~200 μm, and is preferably 30 μm~180 μm.

An example of a film as the gas barrier layer may include a metal thin film composed of aluminum or the like; a resin film composed of vinylidene chloride (PVDC), ethylene-vinylalcohol copolymer (EVOH), or the like; or any synthetic resin film (which may be the base film layer, for example) on which an inorganic oxide, such as aluminum, aluminum oxide, or silica, is deposited (or sputtered). The thickness of the gas barrier layer is, for example, 0.1 μm~20 μm, preferably 0.2 μm~10 μm.

The sheet material may be provided with a print layer (not illustrated) used for displaying a trade name or ingredients of the contents, a product description, such as precautions, or other items including a variety of designs. For example, the print layer may be formed on an inner surface of the base film layer by means of a publicly-known method, such as gravure printing.

The seal part is preferably formed by heat sealing. The seal part formed by heat sealing may be implemented by thermal composition bonding of the sheet materials superimposed on top of another with their sealant layers positioned on an inner side of the container.

As shown in FIG. 1, the pouch container 10 is equipped, in a center region of the top sheet 14, with a mouth plug 30 from which the contents are filled or extracted. The mouth plug 30 consists of a spout 31 secured to the top sheet 14 and a cap 32 screwed onto a thread formed on the outer circumference of the spout 31.

As shown in FIGS. 2A and 3, the pouch container 10 can be folded and collapsed into a slimmed shape before the contents are filled therein. Specifically, the upper end region 11*a* of the front sheet 11 is folded toward a front surface body region 11*b* of the front sheet 11 so as to form a substantially V-shaped folded body part 23 between the upper end region 11*a* and the front surface body region 11*b*. In this position, the edge region 14*a* on one side of the top sheet 14 joined to the upper end region 11*a* of the front sheet 11 constitutes the substantially V-shaped folded body part 23 in conjunction with the upper end region 11*a* of the front sheet 11. Meanwhile, an edge region 14*b* on the other side of the top sheet 14 located on the opposite side of the folded body part 23 and an upper end region 12*a* of the rear sheet 12 joined to the other side edge region 14*b* upwardly extend together, to thereby form a container tip end part 10*a* of the pouch container 10.

Because the front sheet 11 and the rear sheet 12 constituting a part of the pouch container 10 are formed of a sheet material which is flexible and robustly elastic, when the top sheet 14 of the folded and collapsed pouch container 10 as shown in FIG. 3 is downwardly pressed, the folded body part 23 is brought into a closed state with the upper end region 11*a* and the front surface body region 11*b* of the front sheet 11 contacted to each other. On the other hand, when the force to press the top sheet 14 is eliminated, the folded body part 23 is opened so as to have the substantially V shape.

The spout 31 includes a cylindrical region 31*a* projected outward from the top sheet 14 and a flange region 31*b* integrally formed on an end of the cylindrical region 31*a*. In this embodiment, the flange region 31 has a substantially rectangular shape, and is attached to an inner surface of the top sheet 14 (i.e. the surface on a filling part 17 side) by, for example, heat sealing. The shape of the flange region 31*b* is not limited to the rectangular shape, and may have another shape, such as, for example, a circular shape, an elliptical shape, an oval shape, or a polygonal shape.

The cylindrical region 31*a* of the spout 31 includes, on its outer circumferential surface, two flanges f1 and f2. The two flanges f1 and f2 are formed substantially in the same shape and size. One of the flanges, or flange f1, is spaced apart from the other of the flanges, or flange t2 along an axial direction of the spout 31 (corresponding to the front and back direction in FIG. 2A). In addition, four flat regions g1, g2, g3, and g4 are defined on the outer circumferential surface of the spout 31. The flat regions g1, g2, g3, and g4 are extended along a direction substantially orthogonal to the axial direction of the spout 31. The flat regions g1, g2, g3, and g4 are disposed between the two flanges f1 and f2 in the axial direction of the spout 31. In FIG. 2A the position of each of the flat regions g1, g2, g3, and g4 is deviated toward the center of the spout 31 from the outer circumference of the flange f1. In the condition shown in FIG. 2A among the four flat regions g1, g2, g3, and g4, one pair of the flat regions g1 and g2 are opposed substantially in parallel to each other, and extended along the width direction of the pouch container 10, while the other pair of the remaining flat regions g3 and g4 are opposed substantially in parallel to each other and extended along the vertical direction of the pouch container 10.

When the contents are filled from the spout 31 into the filling part 17 of the pouch container 10, the bottom sheet 13 is unfolded while separating the front sheet 11 away from the rear sheet 12, which leads to a form of the body part swollen as shown in FIG. 1. In this state, the cap 32 is screwed into the spout 31 to seal the contents within the pouch container 10. Accordingly, a freestanding property of the pouch container 10 is manifested. Because the top sheet 14 is provided to the pouch container 10, the container top part is also expanded as shown in FIG. 1, which allows the pouch container 10 to take a bottle-like shape.

Figure 4:
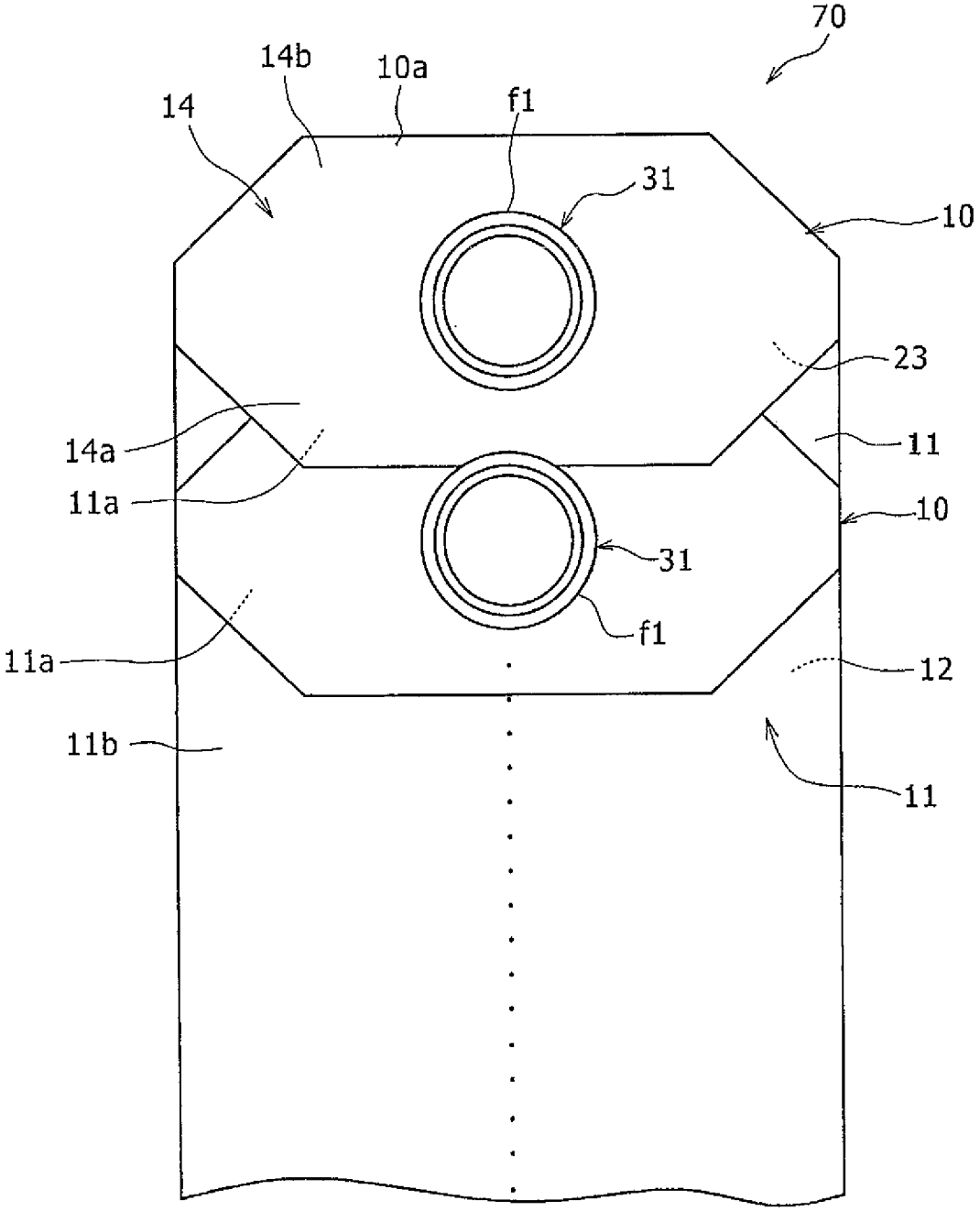
FIG. 4 is a plan view showing a pouch container aligned structure.

FIG. 4 is a plan view of a pouch container aligned structure 70 according to an embodiment of the present invention. In FIG. 4 (and in FIG. 7), the broken line represents an omitted repetition of three or more aligned pouch containers 10.

As shown in FIG. 4, the pouch contain aligned structure (hereinafter simply referred to as an "aligned structure" where appropriate) 70 is composed of two or more pouch containers 10 aligned in a line along one direction. In the aligned structure 70, the folded body part 23 of one of the pouch containers 10 receives the container tip end part 10*a*, which is inserted therein, of another one of the pouch containers 10 adjacent to the one of the pouch containers 10. Further, in this state, edges regions of the body parts are aligned on both sides of each of the pouch containers 10. In addition, the folded body part 23 of the one of the pouch containers 10 may preferably contact with the spout 31 of the other adjacent one of the pouch containers 10. In this way, the pouch container aligned structure 70 is obtained, in which two or more pouch containers 10 are aligned in one direction.

According to the pouch container aligned structure 70 of this embodiment, because, in the pouch containers 10 aligned in one direction, the V-shaped folded body part 23 of one of the pouch containers 10 receives an insertion of the container tip end part 10*a* of another, adjacent one of the pouch containers 10, which is a joint region of the top sheet 14 and the upper end region 12*a* of the rear sheet 12 in the other adjacent one of the pouch containers 10, the pouch containers 10 are prevented from being separated from each other, which can facilitate maintaining the pouch containers 10 in a cluster, and thus can facilitate handling of the pouch containers 10. As a result, it becomes possible to automatically and efficiently load the pouch containers 10 into a filler machine to fill the contents. In addition, the pouch containers 10 gathered in the cluster can be stored in an orderly manner in a packaging material, such as a cardboard box, with a high degree of volume efficiency.

Figure 5:
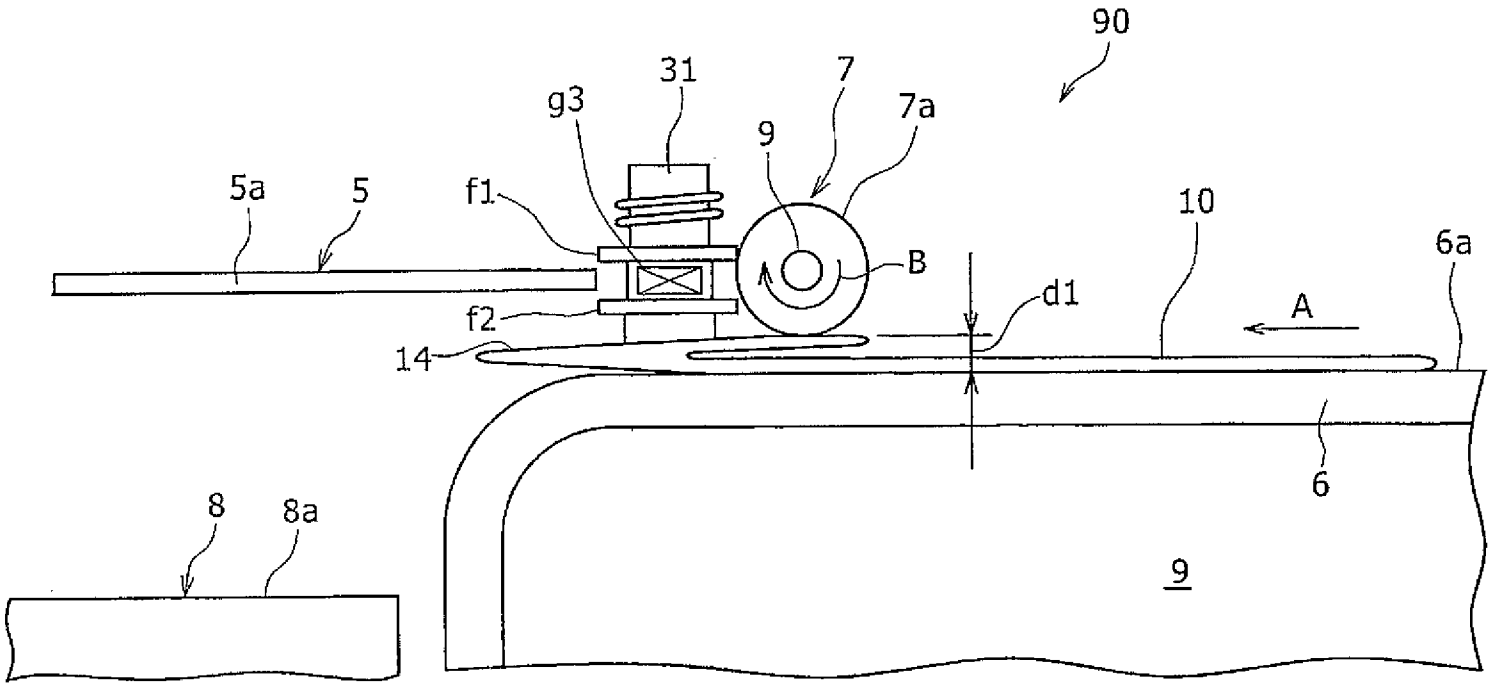
FIG. 5 is a schematic configuration diagram showing, in a state viewed along a horizontal direction, a manufacturing device for manufacturing the pouch container aligned structure of FIG. 4.
Figure 6:
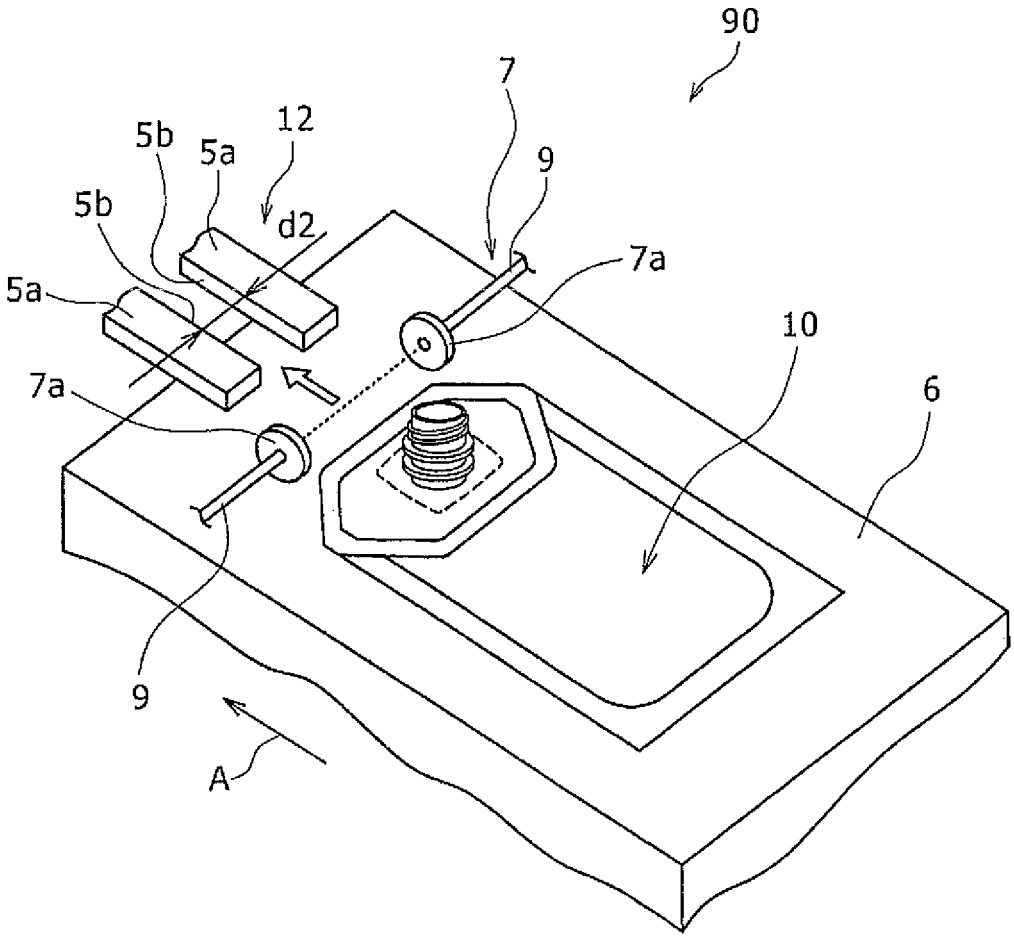
FIG. 6 is a perspective view of the manufacturing device of in FIG. 5.

The above-described pouch container aligned structure 70 is manufactured with a manufacturing device as described below. FIG. 5 is a schematic configuration diagram showing, in a state viewed along the horizontal direction, a manufacturing device 90 for manufacturing the pouch container aligned structure 70 illustrated in FIG. 4. FIG. 6 is a perspective view of the manufacturing device 90 illustrated in FIG. 5. In FIG. 6, a pouch posture adjusting member 8 is not illustrated.

As shown in FIG. 5, the manufacturing device 90 includes a belt 6 functioning as a placement unit, a delivery roller arrangement 7 functioning as a delivery unit for delivering the pouch container 10, and a guide unit 5 for receiving the delivered pouch container 10 while guiding it to align the pouch container 10 in a line. Further, it is preferable that the manufacturing device 90 is equipped with the pouch posture adjusting member 8.

The belt 6 is driven to move along an arrow A direction by a non-illustrated drive unit. The pouch container 10 folded and collapsed in the state shown in FIG. 2 is placed on an upper surface 6*a* of the belt 6 in a position and orientation where the spout 31 is located on a downstream side in a delivery direction, and a vertical direction of the container is matched to the delivery direction. When the belt 6 is driven in that state, the pouch container 10 is delivered toward the guide unit 5.

The delivery roller arrangement 7 includes a pair of delivery rollers 7*a*. The pair of delivery rollers 7*a* have a function of feeding the pouch container 10 delivered by the belt 6 into the guide unit 5. The pair of delivery rollers 7*a* are opposed to each other so as to form a predetermined gap between the pair of delivery rollers 7*a* and the upper surface 6*a* of the belt 6. Here, a dimension d1 of the predetermined gap is, as described below, defined to allow, when the folded and collapsed pouch container 10 as shown in FIG. 2A is delivered by the belt 6 to the delivery rollers 7*a*, the delivery rollers 7 to make contact with the flange region 31*b* of the spout 31 through the top sheet 14.

The delivery rollers 7*a* are connected to a rotation shaft 9. The delivery rollers 7*a* are configured to be rotatably driven in a direction shown by an arrow B in FIG. 5 by the drive unit (not illustrated), such as a motor, connected to the rotation shaft 9. The rotation speed of the circumference of the delivery roller 7*a* is preferably set at a speed equal to a travel speed of the belt 6 that delivers the pouch container 10 (i.e. a delivery speed of the pouch container 10). In this way, it can be ensured that a conveying force of the belt 6 and a rotation force of the delivery rollers 7*a* cooperatively feed the spout 31 of the pouch container 10 into the guide unit 5 reliably as described below.

As shown in FIG. 6, the pair of delivery rollers 7*a* in the delivery roller arrangement 7 are disposed at a distance from each other. The distance between the pair of delivery rollers 7*a* is defined to be greater than the diameter of the cylindrical region 31*a* of the spout 31 and smaller than the width of the flange region 31*b* of the spout 31 in the direction along the container width direction. In this way, the pair of delivery rollers 7*a* are configured to press, through the top sheet 14, the flange region 31*b* on both sides of the cylindrical region 31*a* of the spout 31, which will be described below. However, the pair of delivery rollers 7*a* is not limited to the above-described configuration, and the distance between the pair of delivery rollers 7*a* may be defined to be greater than the width of the flange region 31*b*, to thereby cause the delivery rollers 7*a* to make contact with the top sheet 14 at locations out of the flange region 31*b*.

As shown in FIGS. 5 and 6, the guide unit 5 extends in parallel to the upper surface 6*a* of the belt 6. The guide unit 5 is composed of two substantially identical guide rails (guide members) 5*a* which are placed in parallel at a certain distance from each other. Mutually opposed guiding surfaces 5*b* and 5*b* of the two guide rails 5*a* respectively have flat shapes and extend substantially in parallel to each other. Further, a distance d2 between the two guiding surfaces 5*b* and 5*b* is defined to be slightly greater than a width dimension between the pair of parallel flat regions g3 and g4 (only one of which is shown in FIG. 5) formed on the outer circumference of the spout 31. Still further, a dimension of the height of the guiding surface 5*b*, which is a side surface corresponding the thickness of the guide rail 5*a*, is defined to be smaller than the dimension between the two flanges f1 and f2 formed on the outer circumference of the spout 31. In this way, the guide rails 5*a* are fittingly inserted between the two flanges f1 and f2 of the spout 31 when the pouch container 10 is fed into the guide unit 5 by the delivery rollers 7*a*, which causes the pair of flat regions g3 and g4 formed between the flanges f1 and f2 to be received between the guiding surfaces 5*b* of the pair of guide rails 5*a* while being guided by them. It should be noted that although the example of the guiding surfaces 5*b* and 5*b* in the flat shapes has been described in this embodiment, the guiding surfaces 5*b* and 5*b* are not limited to the flat shapes, and may be formed as substantially triangular surfaces, semi-circular surfaces, or the like.

The pouch posture adjusting member 8 composed of a table member, for example, has a top surface 8*a* parallel to the guide rail 5*a*. The distance from the guide unit 5 to the upper surface 6*a* of the belt 6 is defined to be shorter than the distance from the guide unit 5 to the top surface 8*a* of the pouch posture adjusting member 8. Under this condition, when the spout 31 of the pouch container 10 is retained by the pair of guide rails 5*a*, a lower part of the pouch container 10 is caused to contact the top surface 8*a* of the pouch posture adjusting member 8.

In the manufacturing device 90 configured as described above, the pouch container aligned structure 70 is manufactured as described below.

Firstly, in a pouch container placement step, the pouch container 10, which is in the form shown in FIG. 2, is delivered from a non-illustrated pouch container producing device and placed on the upper surface 6*a* of the belt 6. In this step, the pouch container 10 may be folded and collapsed as shown in FIG. 2(*a*), for example, by means of a robot hand, and loaded to rest in a state where the vertical line passing through the center of the spout 31 lies on the width center of the belt 6. Alternatively, during the course of delivery along the arrow A direction, the pouch container 10 placed on the belt 6 may be adjusted by a non-illustrated guide member to the precisely aligned position and orientation.

When the belt 6 is driven in the arrow A direction in the above-described state, the pouch container 10 is moved toward the delivery rollers 7*a*. Then, when the pouch container 10 arrives at the position of the delivery rollers 7*a*, the top sheet 14 and the upper end regions 11*a* and 12*a* of the front and rear sheets 11 and 12 constituting a part of the pouch container 10 (see FIG. 2) are inserted between the belt 6 and the delivery rollers 7*a* rotating along the arrow A direction.

Figure 7:
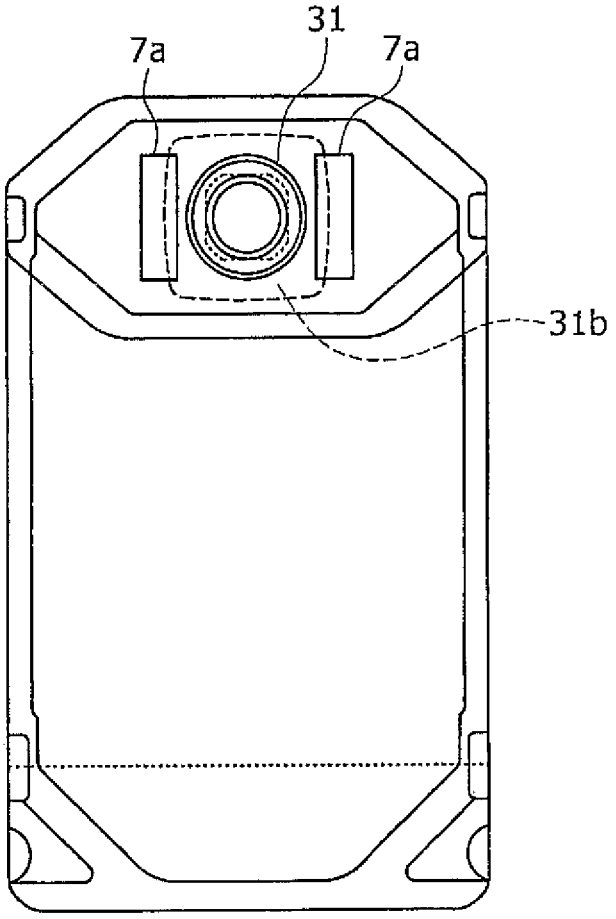
FIG. 7 is a plan view of the pouch container of FIG. 2A shown in a state pressed by a pair of delivery rollers.

Then, the two delivery rollers 7*a* are rotatably driven while contacting the pouch container 10 in such a manner that the flange region 31*b* is pressed, as shown in FIG. 7, through the top sheet 14 at locations on both sides of the cylindrical region 31*a* of the spout 31. Accordingly, because the pouch container 10 is delivered with the flange region 31*b* being pressed against the belt 6 by the delivery rollers 7*a*, the position of the pouch container 10 is adjusted to a height at which the pair of guide rails 5*a* are reliably inserted between the two flanges f1 and f2 of the spout 31. Further, because the pouch container 10 is delivered to the guide unit 5 while being pressed, as described above, by the delivery rollers 7*a* at a portion corresponding to the flange region 31*b* whose stiffness is relatively high, the top sheet 14 is prevented from becoming wrinkled, and the pouch container 10 can be delivered in a stable manner.

Next, as a pouch container delivery step, the pouch container 10 with the spout 31 whose height has been adjusted as described above is delivered by the delivery rollers 7*a*. As a result, the pair of guide rails 5*a* are fittingly inserted between the two flanges f1 and f2 of the spout 31. Then, the substantially parallel flat regions g3 and g4 formed between the two flanges f1 and f2 on the spout 31 are brought into contact with the guiding surfaces 5*b* of the pair of guide rails 5*a* and guided by them. Accordingly, the spout 31 is inserted between the guide rails 5*a* without being rotated relative to the guide rails 5*a* in a state where the orientation of the pouch container 10 has been controlled.

Following the insertion, other pouch containers 10 delivered by the belt 6 and the delivery rollers 7*a* are successively moved in a similar manner to the pair of guide rails 5*a*. Here, the pouch container 10 delivered to the pair of guide rails 5*a* following a previous pouch container 10 pushes and moves the previous pouch container 10 along the extending direction of the guide rails 5*a*. Such actions are repeated to place two or more pouch containers 10 in position aligned in one direction.

Figure 8:
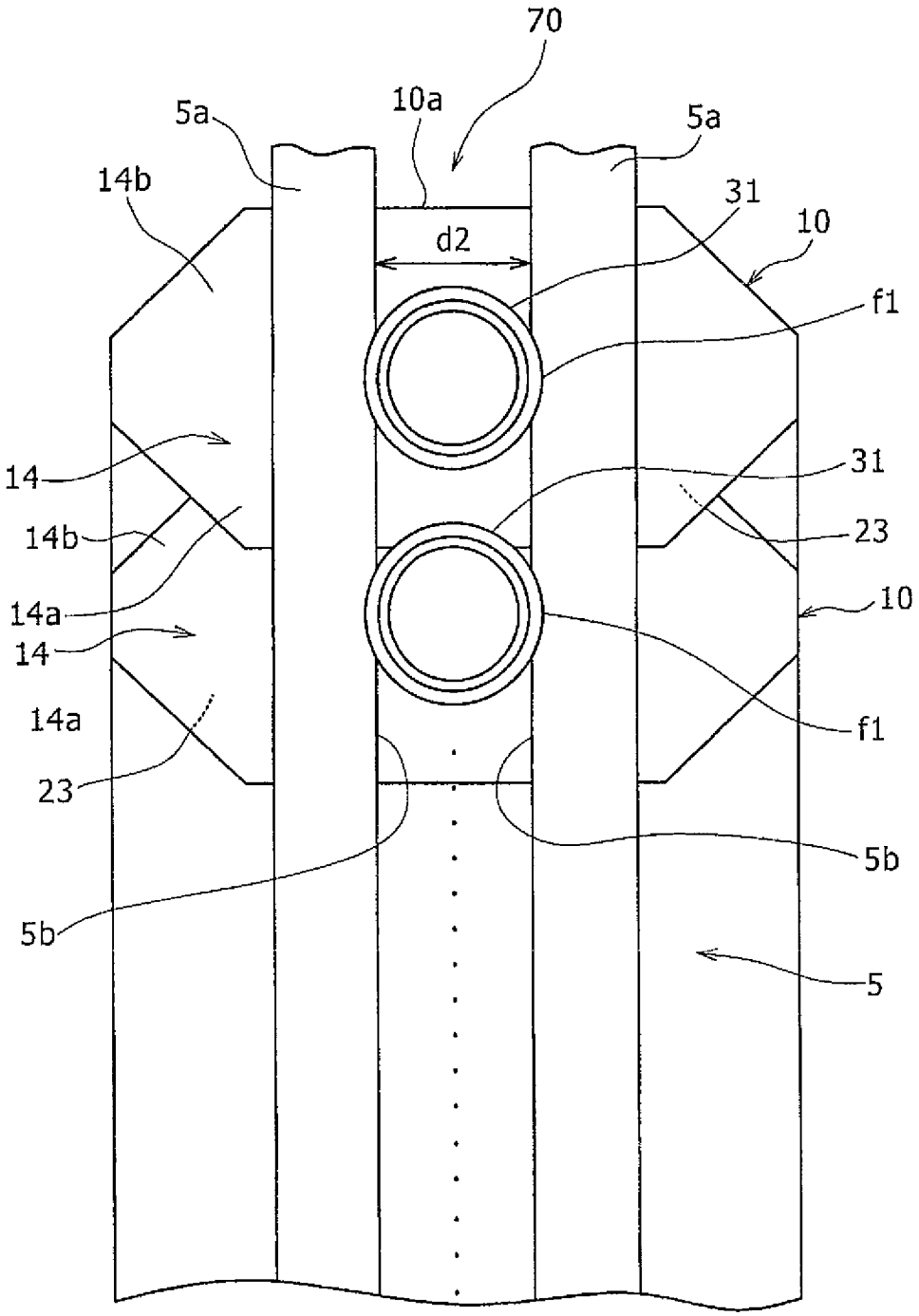
FIG. 8 is a plan view showing an arrangement of two or more pouch containers overlappingly aligned in one direction by a pair of guide rails in the manufacturing device.
Figure 9A:
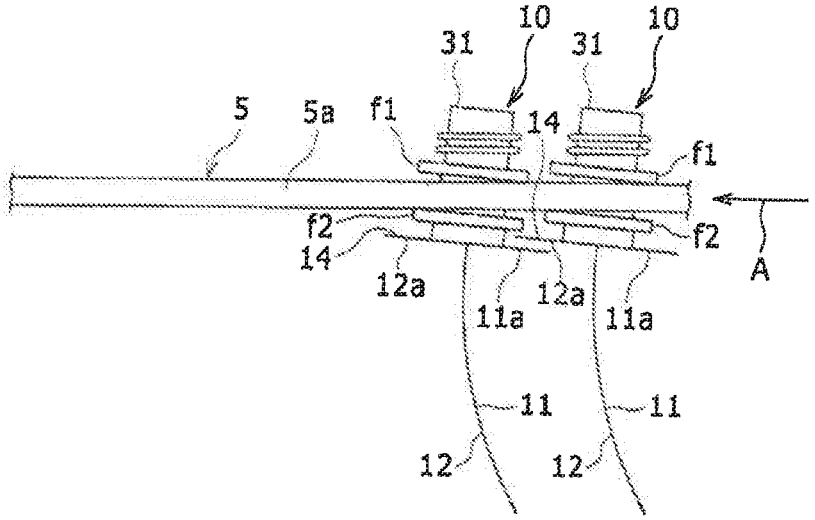
FIG. 9A is a schematic diagram for explaining functions a case without a pouch posture adjusting member.
Figure 9B:
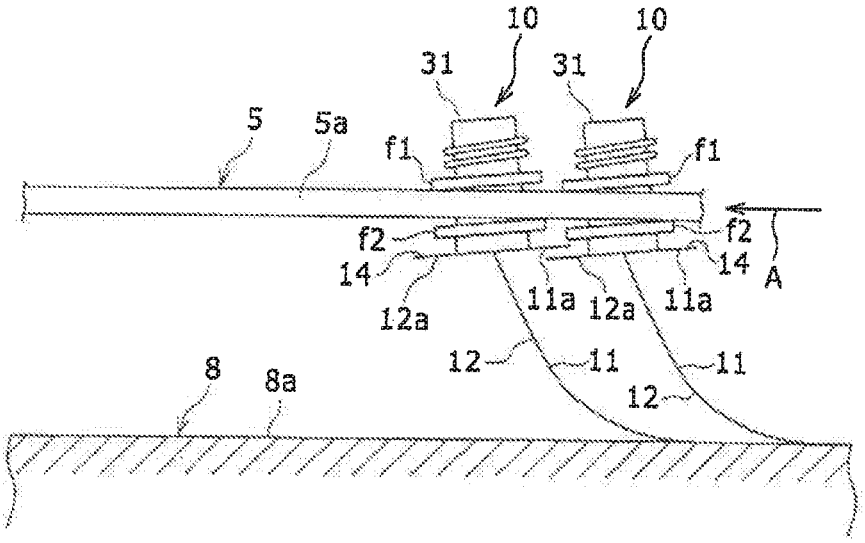
FIG. 9B a schematic diagram for explaining functions of a pouch posture adjustment member.

FIG. 8 is a plan view of the two or more pouch containers 10 aligned in one direction by the pair of guide rails 5*a* in the manufacturing device 90. FIG. 9 is a schematic drawing for explaining a function of the pouch posture adjusting member, in which FIG. 9A shows a manufacturing device without including the pouch posture adjusting member 8, and FIG. 9B shows the manufacturing device 90 including the pouch posture adjusting member 8 according to this embodiment. Further, in FIG. 9A and FIG. 9B, inclination of the pouch container 10 relative to the guide rail 5*a* is exaggerated for the purpose of illustrating the role of the pouch posture adjusting member 8 in a comprehensive manner.

As shown in FIG. 8, the diameter of the flanges f1, f2 in the spout 31 is defined to be greater than the distance d2 between the pair of guide rails 5*a*. For this reason, vertical movement of the spout 31 inserted between the pair of guide rails 5*a* is limited. Thus, as shown in FIG. 9, the pouch container 10 is maintained in a state suspended by the pair of guide rails 5*a*.

A clearance from the two flanges f1 and f2 to the guide rail 5*a* positioned between the two flanges f1 and f2 may become greater due to variations in tolerance or other factors. If this is the case, in the manufacturing device which does not include the pouch posture adjusting member 8, because no force is applied from below to correct the posture of the pouch container 10, the joint region of the top sheet 14 and the upper end region 11*a* of the front sheet 11 in the pouch container 10 located forward in the container delivery direction (the arrow A direction) may be overlappingly mounted by a joint region of the top sheet 14 and the upper end region 12*a* of the rear sheet 12 in another pouch container 10 following the forward pouch container 10.

On the other hand, in the manufacturing device 90 equipped with the pouch posture adjusting member 8 according to this embodiment, the lower part of the pouch container 10 is caused to contact the top surface 8*a* of the pouch posture adjusting member 8, to thereby adjust the posture of the pouch container 10 inserted in and retained by the guide unit 5. Specifically, under the joint region of the top sheet 14 and the upper end region 11*a* of the front sheet 11 in the pouch container 10 located forward in the container delivery direction (the arrow A direction), the joint region of the top sheet 14 and the upper end region 12*a* of the rear sheet 12 in the following other pouch container 10 is introduced. As a result of this, the folded body part 23 of the forward pouch container 10 receives, as shown in FIG. 8, an insertion of the container tip end part 10*a*, which is composed of the edge region on the other side of the top sheet 14 and the upper end region 12*a* of the rear sheet 12 in the following other pouch container 10.

As has been described above, according to the manufacturing device 90 and the manufacturing method for the pouch container aligned structure 70 in this embodiment, it becomes possible to manufacture the pouch container aligned structure 70 which can provide efficient automatic loading to the filler machine and storage into a packaging material with a high degree of volume efficiency.

It should be noted that although the manufacturing device 90 has been described with reference to the example equipped with the pouch posture adjusting member 8 for ensuring that the folded body part 23 of the one of the pouch containers 10 reliably receives the container tip end part 10*a* of the other one of the pouch containers 10, the manufacturing device 90 is not limited to the example, and the pouch posture adjusting member may be omitted. In this case, the belt 6 may be extended to exist below the guide unit 5, or another belt mechanism may be installed below the guide unit 5 independent of the belt 6.

Further, in the above embodiment, there is described the example of the spout 31 with the two pairs of parallel flat regions g1, g2 and parallel flat regions g3, g4 formed on the outer circumferential surface of the spout 31, but the spout is not limited to the example. The outer circumferential surface of the spout may only have a single pair of flat regions which become substantially parallel to the vertical direction of the pouch container 10 when the pouch container 10 is in the folded state, and alternatively, no flat region is formed on the outer circumferential surface of the spout.

Figure 10:
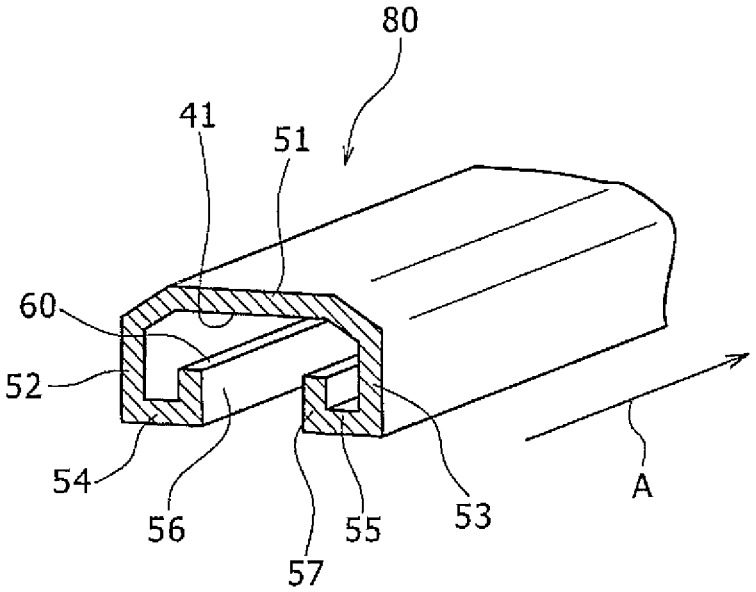
FIG. 10 is a perspective view of a hanger member suitable for handling the pouch container aligned structure in the form of a cluster.

FIG. 10 is a perspective view of a hanger member 80 suitable for handling the pouch container aligned structure 70 in the clustered state. Note that, in FIG. 10, oblique lines represent the end surface of the hanger member 80.

The hanger member 80 corresponds to the guide unit 5 in the manufacturing device 90. The hanger member 80 is an elongated component extending along a direction indicated by an arrow A in FIG. 10. The hanger member 80 may be implemented using a molded resin component, for example.

The hanger member 80 has a concave region 41. The hanger member 80 integrally includes an upper wall 51, a pair of side walls 52 and 53, a pair of lateral walls 54 and 55, and a pair of upright walls 56 and 57. Then, the pair of upright walls 56 and 57 have a function similar to that of the pair of guide rails 5*a* in the manufacturing device 90.

The pouch container aligned structure 70 including the pouch containers 10 aligned in a line by the hanger member 80 may be transferred to another site, or may be packaged while being maintained in the condition retained by the hanger member 80. In this case, because the pouch container aligned structure 70 is retained by the hanger member 80, the pouch containers 10 are prevented from separating from each other, which further facilitates handling of the pouch containers 10 as one cluster.

It is to be understood that the present invention is not limited to the above-described embodiment or its modification example, and may be improved or changed in various ways within the scope of the matters described in the claims of this application or the scope equivalent to the matters.

REFERENCE SIGNS LIST

5 guide unit; 5*a* guide rail; 5*b* guiding surface; 6 belt; 6*a* upper surface (of belt); 7 delivery roller arrangement; 7*a* delivery roller; 8 pouch posture adjusting member; 8*a* top surface (of pouch posture adjusting member); 9 rotation shaft; 10 pouch container; 10*a* tip end part or joint region; 11 front sheet (body sheet); 11*a* upper end region (of front sheet); 11*b* front surface body region; 12 rear sheet (body sheet); 12*a* upper end region (of rear sheet); 12*b* rear surface body region; 13 bottom sheet; 14 top sheet; 14*a* edge region on one side; 14*b* edge region on the other side; 15 folding line; 16 unsealed region; 17 filling part; 20 top seal part; 21 bottom seal part; 22 side seal part; 23 folded body part; 30 mouth plug; 31 spout; 31*a* cylindrical region; 31 flange region; 32 cap; 41 concave region; 51 upper wall; 52, 53 side wall; 54, 55 lateral wall; 56, 57 upright wall; 70 pouch container aligned structure; 80 hanger member; 90 manufacturing device; d1 dimension; d2 distance; f1, f2 flange; g1, g2, g3, g4 flat region; W width.

The invention claimed is:

1. A pouch container aligned structure comprising:

a plurality of pouch containers aligned in one direction, each of the pouch containers including: (i) a pair of body sheets joined to each other on both side edges in a width direction of the body sheet, (ii) a bottom sheet joined to lower end regions of the pair of body sheets, (iii) a top sheet joined to upper end regions of the pair of body sheets, and (iv) a spout mounted on the top sheet, wherein:

each of the pouch containers has a folded body part formed by folding, substantially in a V shape, the upper end region of one body sheet in the pair of body sheets, wherein an edge region on one side of the top sheet is joined to the upper end region of the one body sheet in the pair of body sheets, to thereby form the folded body part together with the upper end region, while an edge region on the other side of the top sheet is joined to the upper end region of the other body sheet in the pair of body sheets, to thereby form a container tip end part, and each of the pouch containers is aligned in a state where the folded body part of one of the pouch containers receives an insertion of the container tip end part of another one of the pouch containers such that the pouch containers are overlapped in a state in which outer surfaces of body sheets of the one pouch container and the another pouch container contact each other, respectively.

2. The pouch container aligned structure according to claim 1, wherein a pair of substantially parallel flat regions are formed on an outer circumferential surface of the spout and are configured to be guided by a pair of guiding members.

3. The pouch container aligned structure according to claim 1, wherein the folded body part of the one of the pouch container is in contact with the spout of the other one of the pouch containers.

4. The pouch container aligned structure according to claim 2, wherein the folded body part of the one of the pouch container is in contact with the spout of the other one of the pouch containers.

* * * * *